US010914224B2

(12) United States Patent
Shioda

(10) Patent No.: US 10,914,224 B2
(45) Date of Patent: Feb. 9, 2021

(54) EXHAUST STRUCTURE FOR INTERNAL COMBUSTION ENGINE

(71) Applicant: TOYOTA JIDOSHA KABUSHIKI KAISHA, Toyota (JP)

(72) Inventor: Jumpei Shioda, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/528,011

(22) Filed: Jul. 31, 2019

(65) Prior Publication Data

US 2020/0080462 A1 Mar. 12, 2020

(30) Foreign Application Priority Data

Sep. 7, 2018 (JP) ..... 2018-167659

(51) Int. Cl.
*F01N 13/00* (2010.01)
*F01N 11/00* (2006.01)

(52) U.S. Cl.
CPC ..... *F01N 13/008* (2013.01); *F01N 11/002* (2013.01); *F01N 2560/08* (2013.01)

(58) Field of Classification Search
CPC .... F01N 13/08; F01N 13/008; F01N 13/1805; F01N 2450/24; F01N 13/30
USPC ..... 60/277, 297, 311, 323
See application file for complete search history.

(56) References Cited

U.S. PATENT DOCUMENTS 4,969,354 A * 11/1990 Kosuda ..... G01L 23/24 73/114.37
7,192,463 B2 * 3/2007 Shutty ..... F01N 13/008 174/50
9,217,355 B2 * 12/2015 Boahene ..... F01N 13/008
9,593,618 B2 * 3/2017 Runde ..... F01N 3/021
2005/0005773 A1 * 1/2005 Shutty ..... F02D 41/3005 96/417
2014/0366516 A1 * 12/2014 Mitsuda ..... F01N 3/0235 60/320
2014/0373721 A1 * 12/2014 Sandou ..... F01N 3/0211 96/421
2015/0000389 A1 * 1/2015 Runde ..... G01M 15/102 73/114.75

FOREIGN PATENT DOCUMENTS

JP 2006-291909 * 10/2006
JP 2014-058896 * 9/2012
JP 2017-206981 A 11/2017

OTHER PUBLICATIONS

Machine Translation JP 2006-291909 (Year: 2020).*

* cited by examiner

*Primary Examiner* — Audrey K Bradley
*Assistant Examiner* — Dapinder Singh
(74) *Attorney, Agent, or Firm* — Oliff PLC

(57) ABSTRACT

An internal combustion engine includes an exhaust pipe having an interior through which exhaust gas flows, a pressure delivery pipe connected to the exhaust pipe, an interior of the pressure delivery pipe communicating with the interior of the exhaust pipe, a pressure sensor connected to the pressure delivery pipe, the pressure sensor detecting a pressure of the interior of the exhaust pipe, and a fastener that fixes the pressure delivery pipe to the exhaust pipe. A part of the fastener is exposed in the interior of the exhaust pipe.

3 Claims, 2 Drawing Sheets

EXHAUST STRUCTURE FOR INTERNAL COMBUSTION ENGINE

BACKGROUND

1. Field

The following description relates to an exhaust structure for an internal combustion engine.

2. Description of Related Art

Japanese Laid-Open Patent Publication No. 2017-206981 discloses an internal combustion engine provided with a catalytic converter, which purifies nitrogen oxides and the like in exhaust gas. The catalytic converter is located in the middle of an exhaust passage. Further, a particulate filter, which captures particulate matter in exhaust gas, is arranged in the exhaust passage at the downstream side of the catalytic converter. A portion of the exhaust passage between the catalytic converter and the particulate filter is connected to one end of a pressure delivery pipe, through which the pressure of exhaust gas is discharged to the outside. The other end of the pressure delivery pipe is connected to a differential pressure sensor, which compares the pressure of exhaust gas with the atmospheric pressure. The internal combustion engine includes a controller, which detects clogging of the particulate filter based on output signals from the differential pressure sensor.

In some cases, in the technique of Japanese Laid-Open Patent Publication No. 2017-206981, the pressure delivery pipe may be fixed to the exhaust passage by a bracket. In this case, high-temperature exhaust gas flows through the exhaust passage. Thus, the temperature of the exhaust passage can become accordingly high. Exhaust gas does not flow or only a small amount of exhaust gas flows through the pressure delivery pipe. Thus, the temperature of the pressure delivery pipe does not become relatively high. Such a difference in temperature between the exhaust passage and the pressure delivery pipe can result in the difference in the amount of expansion in the axial direction between the exhaust passage and the pressure delivery pipe. This will displace the exhaust passage relative to the pressure delivery pipe in the axial direction. As a result, load is applied to portions of the exhaust passage and the pressure delivery pipe to which the bracket is connected.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

To solve the above-described problem, a first aspect of the present disclosure provides an exhaust system for an internal combustion engine. The exhaust system includes an exhaust pipe having an interior through which exhaust gas flows, a pressure delivery pipe connected to the exhaust pipe, an interior of the pressure delivery pipe communicating with the interior of the exhaust pipe, a pressure sensor connected to the pressure delivery pipe, the pressure sensor detecting a pressure of the interior of the exhaust pipe, and a fastener that fixes the pressure delivery pipe to the exhaust pipe. A part of the fastener is exposed in the interior of the exhaust pipe.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An exhaust structure for an internal combustion engine 100 according to an embodiment will now be described with reference to drawings. First, the exhaust structure for the internal combustion engine 100 will be schematically described.

Figure 1:
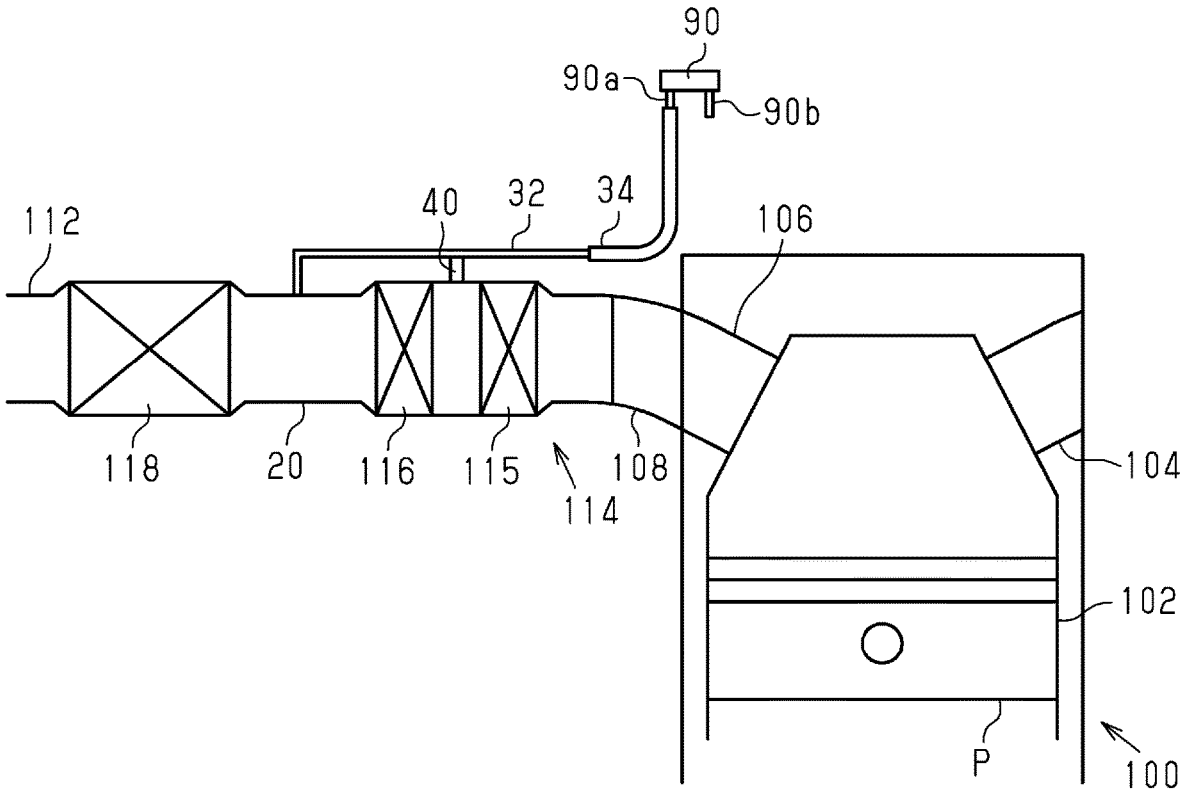
FIG. 1 is a schematic diagram of an exhaust structure for an internal combustion engine.

As shown in FIG. 1, the internal combustion engine 100 includes a plurality of cylinders 102, each of which accommodates a piston P to be movable back and forth. FIG. 1 shows only one of the cylinders 102. The cylinders 102 are each connected to an intake port 104, into which intake air is introduced from the outside. Further, the cylinders 102 are each connected to an exhaust port 106, through which exhaust gas is discharged to the outside. The exhaust port 106 is connected to an exhaust pipe 112 by an exhaust manifold 108, which causes exhaust gas from the cylinders 102 to merge with one another. The exhaust pipe 112 is formed by a metal pipe.

A catalytic device 114, which purifies exhaust gas, is arranged in the middle of the exhaust pipe 112. The catalytic device 114 includes an upstream catalyst 115 and a downstream catalyst 116, which is located downstream of the upstream catalyst 115. Space exists between the upstream catalyst 115 and the downstream catalyst 116. A particulate filter 118, which captures particulate matter contained in exhaust gas, is arranged on the exhaust pipe 112 at the downstream side of the catalytic device 114.

Figure 2:
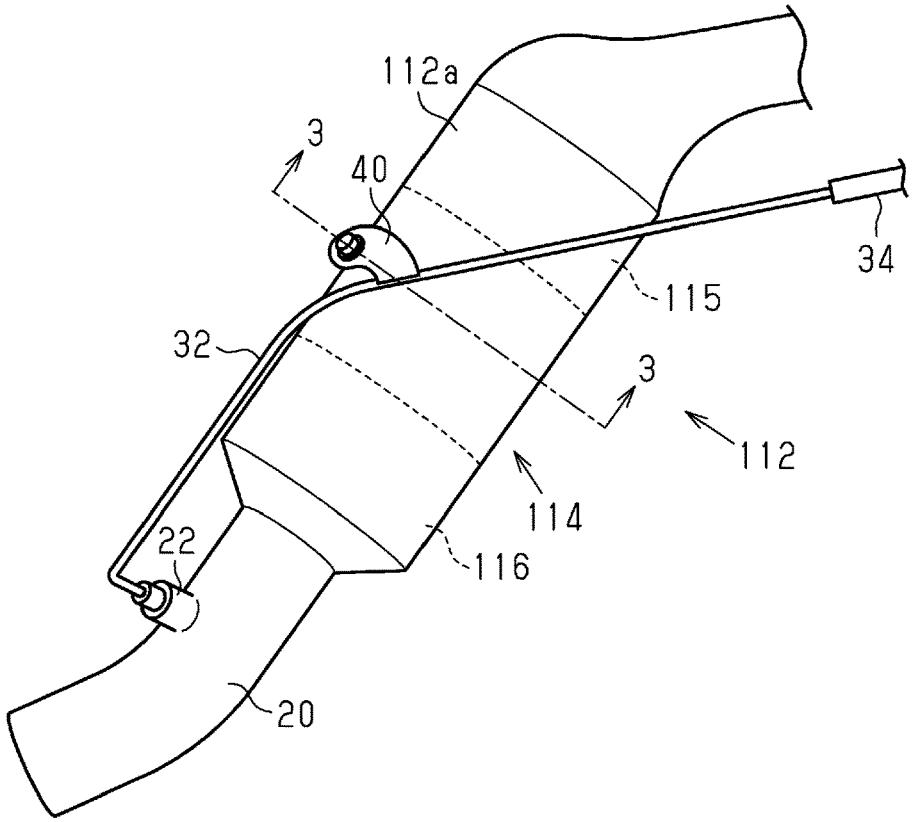
FIG. 2 is a perspective view of an exhaust pipe, a fastener, and a pressure delivery pipe.

As shown in FIGS. 1 and 2, a detection target 20 is arranged at a portion of the exhaust pipe 112 between the catalytic device 114 and the particulate filter 118. The detection target 20 is connected to a first end of a first pressure delivery pipe 32, which is formed by a metal pipe. The interior of the first pressure delivery pipe 32 communicates with the interior of the detection target 20.

A second end of the first pressure delivery pipe 32 is connected to a first end of a second pressure delivery pipe 34, which is formed by a rubber hose. The interior of the second pressure delivery pipe 34 communicates with the interior of the first pressure delivery pipe 32.

A second end of the second pressure delivery pipe 34 is connected to a pressure sensor 90, which detects the pressure of exhaust gas. The pressure sensor 90 includes an exhaust pressure introduction port 90*a*, which introduces the pressure of exhaust gas, and an atmospheric pressure introduction port 90*b*, which introduces the atmospheric pressure. The exhaust pressure introduction port 90*a* is connected to the second end of the second pressure delivery pipe 34. Thus, the pressure of exhaust gas in the detection target 20 is delivered into the exhaust pressure introduction port 90*a* through the first pressure delivery pipe 32 and the second pressure delivery pipe 34. In this manner, the first pressure delivery pipe 32 and the second pressure delivery pipe 34 configure a pressure delivery pipe that delivers the pressure of exhaust gas to the pressure sensor 90.

Although not shown in the drawings, a diaphragm is provided in the pressure sensor 90. The diaphragm deforms in accordance with the pressure of exhaust gas introduced from the exhaust pressure introduction port 90*a* and the atmospheric pressure introduced from the atmospheric pressure introduction port 90*b*. The difference between the pressure of exhaust gas and the atmospheric pressure is detected based on the deformation amount of the diaphragm.

The structure of fixing the first pressure delivery pipe 32 to the exhaust pipe 112 will now be described in more detail.

Figure 3:
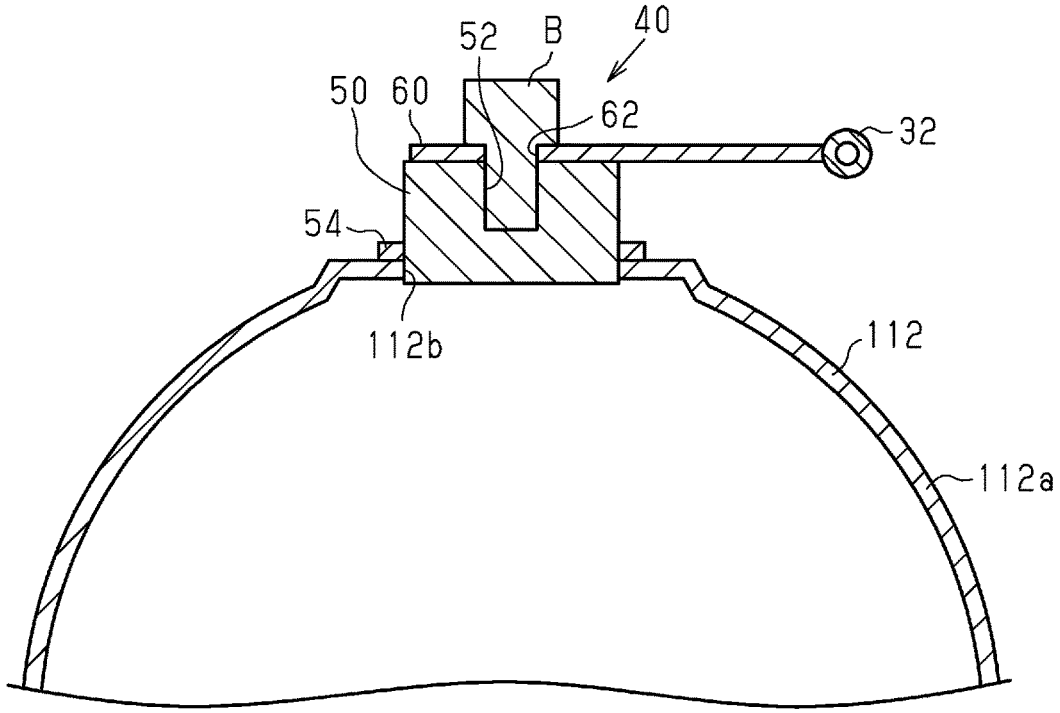
FIG. 3 is a cross-sectional view taken along line 3-3 in FIG. 2.

As shown in FIG. 3, the exhaust pipe 112 has a through-hole 112*b*, which extends through an outer circumferential wall 112*a* in the thickness direction. The through-hole 112*b* is located in the catalytic device 114 between the upstream catalyst 115 and the downstream catalyst 116. The through-hole 112*b* has a circular shape in a planar view. The surrounding part of the through-hole 112*b* in the outer circumferential wall 112*a* is flat.

As shown in FIG. 2, a tubular branch port 22 branches from the outer circumferential surface of the detection target 20. The position of the branch port 22 in the circumferential direction of the exhaust pipe 112 is the same as the position of the through-hole 112*b*. The interior of the branch port 22 communicates with the interior of the detection target 20. The first end of the first pressure delivery pipe 32 is inserted into the branch port 22. For example, the first pressure delivery pipe 32 is fastened to the branch port 22 using a nut. The inner diameter of a port of the first pressure delivery pipe 32 connecting to the exhaust pipe 112 is far smaller than the inner diameter of the detection target 20. This prevents a large amount of exhaust gas from flowing into the first pressure delivery pipe 32 although the pressure of the detection target 20 is delivered into the first pressure delivery pipe 32. The first pressure delivery pipe 32 extends toward the upstream side of the exhaust pipe 112. A part of the first pressure delivery pipe 32 extends in the vicinity of the catalytic device 114.

As shown in FIG. 3, the first pressure delivery pipe 32 is fixed to the exhaust pipe 112 by a fastener 40 at a different position than the branch port 22. More specifically, the first pressure delivery pipe 32 is fixed to the exhaust pipe 112 by the fastener 40 in the vicinity of the catalytic device 114. The fastener 40 includes a holder 60, to which the first pressure delivery pipe 32 is coupled. The holder 60 is made of metal and has a flat shape. Further, the holder 60 has a curved belt shape in a planar view. The first pressure delivery pipe 32 is welded to a first end of the holder 60, which is one end of the holder 60 in the longitudinal direction. A bolt hole 62 extends in the thickness direction through a second end of the holder 60, which is the other end of the holder 60 in the longitudinal direction.

The second end of the holder 60 is coupled to an attachment portion 50 of the fastener 40. The attachment portion 50 is made of metal and has a columnar shape. The attachment portion 50 has a bolt hole 52. The bolt hole 52 is recessed from the upper end surface of the attachment portion 50. The diameter of the bolt hole 52 is substantially the same as the diameter of the bolt hole 62 of the holder 60. The upper end surface of the attachment portion 50 is in planar contact with the second end of the holder 60. The bolt hole 52 is located at a position overlapping the bolt hole 62 of the holder 60. A bolt B is inserted through the bolt hole 52 and the bolt hole 62 from the upper surface of the holder 60. The bolt B is screwed to the bolt hole 52 of the attachment portion 50 to couple the holder 60 to the attachment portion 50. Using a tool such as a wrench, the bolt B can be removed from the attachment portion 50 and the holder 60 without breaking the attachment portion 50 and the holder 60. That is, the holder 60 is removable from the attachment portion 50.

An annular portion 54 projects outward in the radial direction from the outer circumferential surface of the attachment portion 50. The annular portion 54 extends over the entire circumference of the attachment portion 50 and has an entirely annular shape. The diameter of a part of the attachment portion 50 from the annular portion 54 to the lower end surface, that is, the diameter of a part of the attachment portion 50 located on a side opposite from the holder 60, is substantially the same as the diameter of the through-hole 112*b* of the exhaust pipe 112.

The lower end surface of the attachment portion 50 is inserted into the through-hole 112*b* toward the interior of the exhaust pipe 112. Thus, the lower end surface of the attachment portion 50 is exposed in the interior of the exhaust pipe 112. Further, a part of the outer circumferential surface of the attachment portion 50 located proximate to the lower end surface of the attachment portion 50 is in planar contact with the inner circumferential surface of the through-hole 112*b* of the exhaust pipe 112. In addition, the annular portion 54 is in planar contact with outer circumferential surface of the outer circumferential wall 112*a* of the exhaust pipe 112. The planar contact of the annular portion 54 with the outer circumferential wall 112*a* determines a protrusion amount of the attachment portion 50 protruding toward the interior of the exhaust pipe 112. The lower end surface of the attachment portion 50 is substantially flush with the inner circumferential surface of the outer circumferential wall 112*a* of the exhaust pipe 112. The annular portion 54 is welded to the outer circumferential surface of the outer circumferential wall 112*a* of the exhaust pipe 112. Thus, the through-hole 112*b* of the exhaust pipe 112 is sealed by the attachment portion 50. Further, the attachment portion 50 is inserted into and fixed to the through-hole 112*b* to configure a part of the outer circumferential wall of the exhaust pipe 112.

The material of the exhaust pipe 112 and the material of the first pressure delivery pipe 32 have the same thermal expansion coefficient. Further, the material of the attachment portion 50 of the fastener 40 and the material of the exhaust pipe 112 have the same thermal expansion coefficient.

The operation and advantages of the present embodiment will now be described.

High-temperature exhaust gas flows through the exhaust pipe 112. Thus, the temperature of the exhaust pipe 112 becomes accordingly high. By contrast, exhaust gas does not flow or only a small amount of exhaust gas flows through the first pressure delivery pipe 32. Thus, the temperature of the first pressure delivery pipe 32 does not become relatively high depending on the amount of exhaust gas in the interior of the first pressure delivery pipe 32. Accordingly, while the internal combustion engine 100 is running, the temperature of the first pressure delivery pipe 32 is lower than the temperature of the exhaust pipe 112.

As the temperature of the exhaust pipe 112 increases, the exhaust pipe 112 thermally expands in the axial direction. In the same manner, the first pressure delivery pipe 32 thermally expands in the axial direction. However, as described above, the temperature of the first pressure delivery pipe 32 does not become relatively high. Thus, the amount of thermal expansion of the first pressure delivery pipe 32 is not relatively large. Accordingly, the thermal expansion amount of the exhaust pipe 112 is larger than the thermal expansion amount of the first pressure delivery pipe 32. When the thermal expansion amount differs between the exhaust pipe 112 and the first pressure delivery pipe 32 in this manner, the distance of the exhaust pipe 112 from the branch port 22 to the through-hole 112*b* becomes larger than the distance from a part of the first pressure delivery pipe 32 inserted into the branch port 22 to a part of the first pressure delivery pipe 32 joined to the holder 60. This shifts the position where the exhaust pipe 112 and the first pressure delivery pipe 32 are fixed to each other. As a result, load is applied to the first pressure delivery pipe 32, the exhaust pipe 112, the fastener 40, and the like, thereby causing breakage such as cracking.

However, in the present embodiment, the attachment portion 50 of the fastener 40 configures a part of the outer circumferential wall 112*a* of the exhaust pipe 112. In addition, the lower end surface of the attachment portion 50 is exposed in the interior of the exhaust pipe 112. This delivers the heat of exhaust gas to the lower end surface of the attachment portion 50 and further delivers the heat from the attachment portion 50 through the holder 60 to the first pressure delivery pipe 32. Thus, the difference in temperature between the exhaust pipe 112 and the first pressure delivery pipe 32 is reduced. This prevents the temperature of the first pressure delivery pipe 32 from being excessively lower than the temperature of the exhaust pipe 112. Thus, the occurrence of a large difference in the thermal expansion amount between the first pressure delivery pipe 32 and the exhaust pipe 112 is limited. This limits the application of an excessive load to the first pressure delivery pipe 32, the exhaust pipe 112, and the fastener 40.

Further, in the present embodiment, the material of the exhaust pipe 112 and the material of the first pressure delivery pipe 32 have the same thermal expansion coefficient. Thus, if the exhaust pipe 112 and the first pressure delivery pipe 32 have substantially the same temperature, the thermal expansion amount in the axial direction of the exhaust pipe 112 is substantially the same as the thermal expansion amount in the axial direction of the first pressure delivery pipe 32. Accordingly, the distance between the part of the exhaust pipe 112 fixed to the attachment portion 50 and the part of the first pressure delivery pipe 32 coupled to the holder 60 does not vary prior to expansion and subsequent to expansion. This reduces load applied to the exhaust pipe 112 and the first pressure delivery pipe 32.

Additionally, in the present embodiment, the material of the attachment portion 50 of the fastener 40 and the exhaust pipe 112 have the same thermal expansion coefficient. Thus, the attachment portion 50 thermally expands an amount that is approximately the same as the thermal expansion amount of the exhaust pipe 112. This limits the occurrence of cracking at the section of the attachment portion 50 joined to the exhaust pipe 112 and prevents the leakage of exhaust gas out of the exhaust pipe 112.

In the present embodiment, the attachment portion 50 of the fastener 40 is joined to the outer circumferential wall 112*a* of the exhaust pipe 112 with the through-hole 112*b* of the exhaust pipe 112 closed by the attachment portion 50. Typically, in this case, the attachment portion 50 has to be joined to the exhaust pipe 112 through welding or the like in order to ensure the prevention of leakage of exhaust gas out of the exhaust pipe 112 with a simple structure. Further, in a structure in which the attachment portion 50 is joined to the exhaust pipe 112 in a non-removable manner, the exhaust pipe 112 needs to be broken to remove the attachment portion 50.

However, in the present embodiment, the attachment portion 50 and the holder 60 are separate from each other and thus removable from each other. Thus, even if the attachment portion 50 is not removed from the exhaust pipe 112, maintenance can be performed for the first pressure delivery pipe 32 by removing the holder 60 from the attachment portion 50, and only the first pressure delivery pipe 32 can be replaced without replacing the exhaust pipe 112.

The present embodiment may be modified as follows. The present embodiment and the following modifications can be combined as long as the combined modifications remain technically consistent with each other.

The amount of the attachment portion 50 protruding toward the interior of the exhaust pipe 112 may be changed. To change the protrusion amount, the position of the annular portion 54 in the axial direction of the attachment portion 50 simply needs to be adjusted.

The shape of the attachment portion 50 may be changed. The attachment portion 50 may be, for example, box-shaped. When the shape of the attachment portion 50 is changed, the shape of the through-hole 112*b* of the exhaust pipe 112 simply needs to be changed such that the attachment portion 50 can be inserted into the exhaust pipe 112.

The attachment portion 50 does not have to be fixed to the exhaust pipe 112 in a state in which the attachment portion 50 is inserted through the through-hole 112*b*. That is, the attachment portion 50 may be configured to cover the through-hole 112*b* of the exhaust pipe 112 from the outer surface of the outer circumferential wall 112*a*. If the attachment portion 50 is exposed in the interior of the exhaust pipe 112 even a little, the temperature of exhaust gas can be delivered through the fastener 40 to the first pressure delivery pipe 32.

The means for joining the attachment portion 50 to the exhaust pipe 112 is not limited to welding. For example, the attachment portion 50 may be joined to the exhaust pipe 112 by, for example, soldering or using adhesive.

As long as exhaust gas does not leak out of the exhaust pipe 112, the attachment portion 50 may be coupled to the exhaust pipe 112 in a removable manner. For example, the attachment portion 50 may be coupled to the exhaust pipe 112 in a removable manner such that a seal is used to seal the gap between the attachment portion 50 and the exhaust pipe 112 to prevent the leakage of exhaust gas.

The attachment portion 50 and the annular portion 54 may be formed integrally in advance.

The shape of the holder 60 may be changed. The holder 60 simply needs to be shaped such that the holder 60 can connect the attachment portion 50 and the first pressure delivery pipe 32 to each other.

The means for coupling the holder 60 to the first pressure delivery pipe 32 is not limited to welding and may be a bolt. That is, any means may be used as long as it can keep the holder 60 and the first pressure delivery pipe 32 coupled to each other. However, it is preferred that the holder 60 and the first pressure delivery pipe 32 be in contact with each other or be joined to each other in a range as broad as possible to deliver heat from the holder 60 to the first pressure delivery pipe 32.

The means for coupling the holder 60 to the attachment portion 50 is not limited to the bolt B and may be a recess and projection for fitting the holder 60 and the attachment portion 50 to each other.

The holder 60 may be coupled to the attachment portion 50 in a non-removable manner. That is, the holder 60 may be integrated with the holder 60 through welding or the like. The holder 60 and the attachment portion 50 may be formed integrally in advance. In terms of heat delivery, it is more advantageous that the holder 60 and the attachment portion 50 are integrated with each other and there is no boundary surface between the holder 60 and the attachment portion 50.

The position of the through-hole 112*b* in the exhaust pipe 112 may be changed both in the axial direction and the circumferential direction of the exhaust pipe 112. For example, the fastener 40 may be arranged on the exhaust pipe 112 at the upstream side of the catalytic device 114 or at the downstream side of the catalytic device 114. In addition, the fastener 40 may be arranged on the side opposite from the branch port 22 in the circumferential direction of the exhaust pipe 112.

The fastener 40 may be arranged at a number of positions of the exhaust pipe 112.

The material of the exhaust pipe 112 and the material of the attachment portion 50 may have different thermal expansion coefficients. In this case, since the attachment portion 50 is exposed in the interior of the exhaust pipe 112, the temperature of the attachment portion 50 can become accordingly high depending on the heat of exhaust gas in the same manner as the exhaust pipe 112. This limits the occurrence of an excessively notable difference in the expansion amount between the attachment portion 50 and the exhaust pipe 112.

The material of the exhaust pipe 112 and the material of the first pressure delivery pipe 32 may have different thermal expansion coefficients. In this case, since the attachment portion 50 is exposed in the interior of the exhaust pipe 112, the heat of exhaust gas can be delivered through the attachment portion 50 to the first pressure delivery pipe 32, thereby reducing the difference in the thermal expansion amount between the exhaust pipe 112 and the first pressure delivery pipe 32.

The exhaust pipe 112 does not have to be entirely made of the same material. The material of some or multiple sections may differ from the material of other sections. To reduce load on the exhaust pipe 112 and the first pressure delivery pipe 32, it is preferred that the material of a section of the exhaust pipe 112 from the branch port 22 to the through-hole 112*b* have the same thermal expansion coefficient as the first pressure delivery pipe 32.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. An exhaust structure for an internal combustion engine, the exhaust structure comprising:

an exhaust pipe having an interior through which exhaust gas flows;

a pressure delivery pipe connected to the exhaust pipe, an interior of the pressure delivery pipe communicating with the interior of the exhaust pipe;

a pressure sensor connected to the pressure delivery pipe, the pressure sensor detecting a pressure of the interior of the exhaust pipe; and a fastener that fixes the pressure delivery pipe to the exhaust pipe, wherein a part of the fastener is exposed at a position at which heat of the exhaust gas is delivered, in the interior of the exhaust pipe.

2. The exhaust structure according to claim 1, wherein the fastener includes an attachment portion joined to the exhaust pipe, the attachment portion configuring a part of an outer circumferential wall of the exhaust pipe; and a holder coupled to the attachment portion such that the holder is removable from an exterior of the exhaust pipe, and the pressure delivery pipe is coupled to the holder.

3. The exhaust structure according to claim 1, wherein a material of a portion of the exhaust pipe to which the fastener is coupled and a material of a portion of the pressure delivery pipe to which the fastener is coupled have the same thermal expansion coefficient.

* * * * *